United States Patent [19]

McGahey

[11] 4,223,706

[45] Sep. 23, 1980

[54] CLOSED FUEL SYSTEM WITH VACUUM ASSIST

[75] Inventor: Dean C. McGahey, Fishkill, N.Y.

[73] Assignee: Texaco Inc., White Plains, N.Y.

[21] Appl. No.: 913,976

[22] Filed: Jun. 8, 1978

Related U.S. Application Data

[63] Continuation-in-part of Ser. No. 750,742, Dec. 15, 1976, abandoned.

[51] Int. Cl.[2] ..... B65B 3/18; B65B 31/00

[52] U.S. Cl. ..... 141/59; 141/290; 141/302; 417/404

[58] Field of Search ..... 141/52, 59, 285, 290, 141/301, 302, 392; 417/404

[56] References Cited

U.S. PATENT DOCUMENTS

| | | | |
|---|---|---|---|
| 3,874,427 | 4/1975 | Tigglebeck | 141/290 |
| 4,082,122 | 4/1978 | McGahey | 141/59 |

*Primary Examiner*—Frederick R. Schmidt

*Attorney, Agent, or Firm*—Carl G. Ries; Robert A. Kulason; Robert B. Burns

[57] ABSTRACT

A system for transferring a volatile liquid fuel into a tank therefor, while avoiding passage of fuel vapors into the atmosphere. Vacuum assist means is provided including a reciprocatory, fuel actuated tandem motor and pump combination, to assure maintenance of a condition in the system which will prompt removal of fuel vapors from the tank being filled.

3 Claims, 1 Drawing Figure

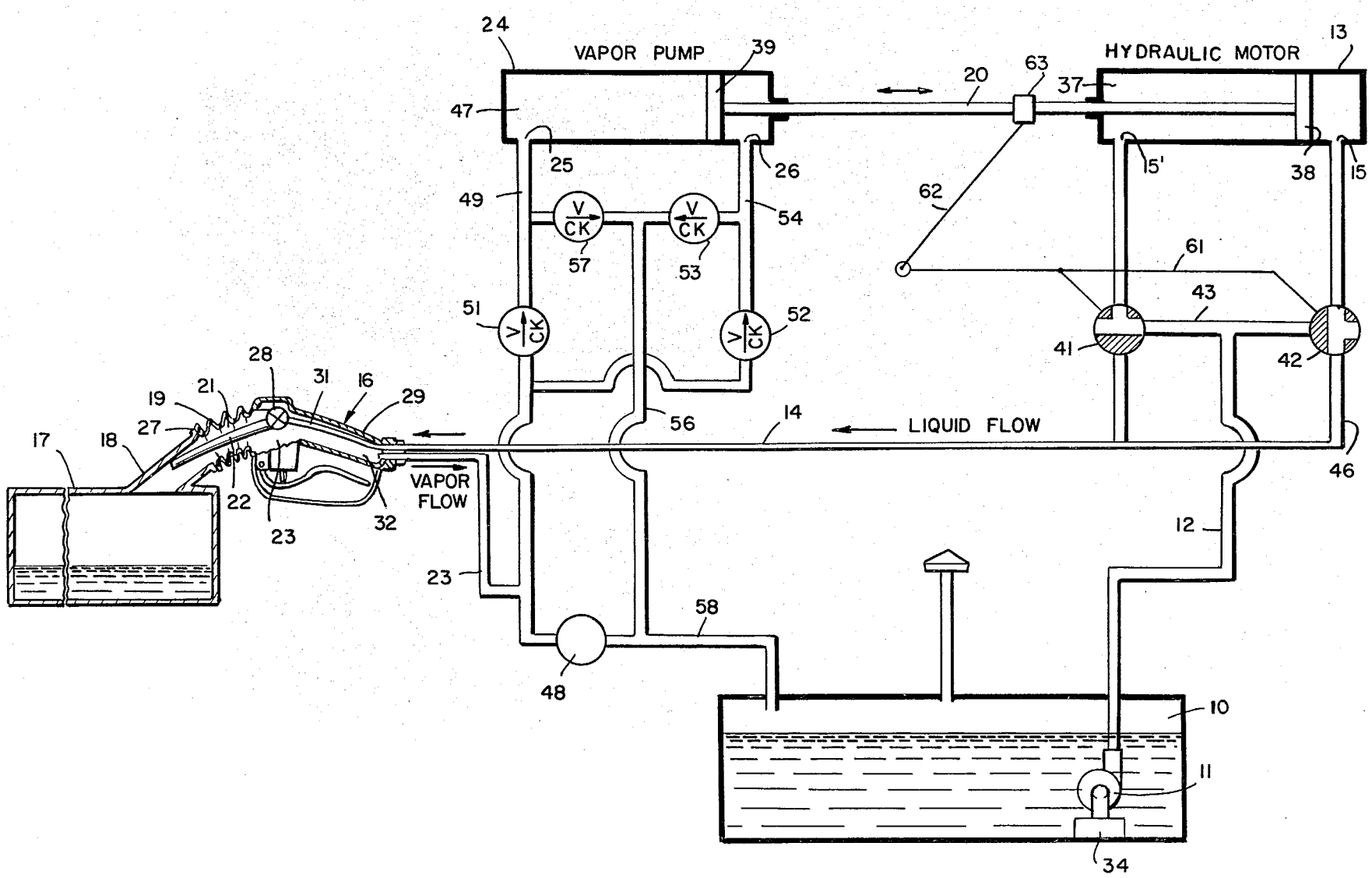
HYDRAULIC MOTOR
VAPOR PUMP
LIQUID FLOW
VAPOR FLOW
V/CK
13
15
38
42
46
61
43
12
10
11
34
15'
37
41
63
20
62
14
39
26
54
52
53
56
58
48
24
25
57
51
47
49
23
29
32
16
31
28
22
21
19
27
18
17

CLOSED FUEL SYSTEM WITH VACUUM ASSIST

This is a continuation-in-part to parent application Ser. No. 750,742, which was filed on Dec. 15, 1976, and is now abandoned.

BACKGROUND OF THE INVENTION

During the transfer of a volatile liquid such as gasoline or a similar fuel from a storage facility, there is normally an unsealed connection made between the disconnectable nozzle and the tank being filled. As the transfer operation progresses, residual gases contained in the tank, as well as air, normally rise into the atmosphere.

Many municipalities and governmental agencies have proposed or adopted regulations intended to reduce or at least control these emissions. One method toward complying with mandated regulations is the provision of a completely closed system between the fuel source or storage facility and the tank being filled.

Such a closed system normally includes a conduit which carries fuel. The remote end of the conduit is provided with a manually operated dispensing nozzle. The latter is adapted to be removably positioned in the filler pipe of the receiving tank, and includes means to form a sealed engagement between the nozzle spout and the tank filler tube.

Also in many instances, the system is not closed but rather is vented to the atmosphere by way of venting means in the storage tank. With such an arrangement, as liquid is pumped out either of two eventualities could occur. If fuel leaving the system is not immediately replaced by vapor from the tank being filled, air will be drawn into the system. On the other hand, when excessive vapors are drawn in from the tank being filled, some of the vapors will have to be vented.

Several embodiments of sealing arrangements have been found to be advantageous for providing the necessary vapor tight, yet disconnectable connection at the nozzle spout. One method for providing the desired seal, is to attach a cylindrical, flexible walled member such as a rubber boot or the like, to the fuel dispensing nozzle. The boot in such a position will substantially surround the nozzle spout when the latter is in place. By use of such an arrangement, when the nozzle is received in the filler pipe of the receiving tank, the walls of the flexible boot will be deflected and/or distorted. The boot will thereby define an annular vapor passage while the resilient contact edge thereof sealably engages the tank filler pipe.

This type of arrangement has generally been found to be highly effective. Thus, when a fuel flow is introduced from the nozzle into the receiving tank, a slight pressure is produced within the tank to displace fuel vapors as well as air. These vapors will be urged upwardly through the annulus defined by the nozzle spout and the flexible member. Said vapors can then be transferred by way of the dispensing nozzle through a separate conduit to the fuel source, or to another reservoir for retaining the vapors.

The effectiveness of this system depends to a large degree on the mechanical compatibility of the vehicle with the nozzle, to permit a tight seal at their interface. If for any reason the contact edge of the nozzle boot cannot engage the filler pipe, a seal cannot be achieved, and a leak will result or develop.

Another potential source of vapor leakage is through the above noted tank vents, which are present on some vehicles, particularly those manufactured prior to 1971. When a leak path does develop, some of the vapor from the tank can be emitted to the atmosphere.

In conjunction with closed fuel systems, vacuum assist means have been devised which cause the vapor collection system to operate under a slight vacuum. This circumstance tends to draw air into the system through any leak paths which exist or develop. It also tends to inhibit the flow of vapor to the atmosphere.

Vacuum assist facilities however often embody the disadvantage of bringing in excessive amounts of air which could produce an undesired mixture in the vapor space. Further, they could produce excessive vent pipe emissions due to the saturation of the excess air as it passes through the system in contact with gasoline.

In the presently disclosed arrangement, a system is provided which incorporates a number of features which include: (1) a tight seal at the vehicle-nozzle interface for those vehicles which permit it; (2) a vacuum assist device adapted to aid in collecting vapors from those vehicles the tanks of which cannot be sealably engaged; (3) the use of a positive displacement, reciprocatory hydraulic motor which is driven by the dispensed gasoline flow. Said drive motor thus actuates a positive displacement reciprocatory vapor pump, thereby controlling the volume of vapor pumped in relation to the volume of gasoline dispensed. It further limits the actual pumping period to the interval when gasoline is being dispensed, and, (4) a valved bypass arrangement automatically operable in conjunction with the vapor pump to limit the establishment of either a positive or a negative pressure which can be imposed on the vapor space between the vehicle tank and the vapor pump.

Toward assuring operation of the overall system under varying circumstances, a valved bypass system or arrangement is provided across the positive displacement vapor pump. The bypass serves to direct vapor between the pump's respective inlet ports, or directly to the vapor storage facility.

An object of the invention therefore is to provide a fuel system which embodies an effective sealing means disposed between the fuel dispensing nozzle and a receiving tank. A further object is to provide a fuel system of the type contemplated which is enhanced in response to the inflow of fuel to the receiving tank. A still further object is to provide a vacuum assist arrangement within a fuel system having a dispensing nozzle, which assistance is adjusted in response to the flow of gasoline flowing to the receiving tank, and to the volume of vapor which is displaced from the tank during the operation.

DESCRIPTION OF THE DRAWINGS

In the drawings, FIG. 1 is an environmental arrangement of the presently disclosed closed fuel system which connects an underground storage tank with a receiving tank to be filled, such as would be contained on an automobile, boat or the like.

Briefly stated, and referring to the drawing, the overall system is shown in FIG. 1 wherein a fuel storage tank 10 of the type normally found in a service station is provided with an electrically driven gasoline supply pump 11. The latter is adapted to be actuated for removing a stream of gasoline or similar volatile liquid. Said pump can be located either at the ground level or as shown, submerged in the fuel.

Pump 11 discharges by way of conductor 12, alternately into the ports 15 and 15' of a hydraulic motor 13. The latter is in turn communicated through an elongated conduit 14 by way of a dispensing nozzle 16, to a fuel tank 17 having a filler pipe 18. When nozzle 16 is engaged with filler pipe 18, a resilient walled boot 19 is deformed to define an annular passage of chamber 21 between the boot itself, and the inwardly disposed nozzle spout 22.

During a fuel transfer operation, as fuel is discharged through hydraulic motor 13 to nozzle 16, a return flow of vapor by way of a second conduit 23 is enhanced by a vapor pump 24. The latter is driven through a direct connection 20, or a suitable transmission means extending between the respective pistons of hydraulic motor 13 and vapor pump 24. Thus, the flow of fuel to tank 17 in effect initiates the concurrent flow of vapor from said tank.

A valved bypass arrangement including valve 48 communicates the inlet ports of vapor pump 24 directly to storage tank 10. Said valved bypass arrangement functions to regulate the system vapor pressure. For example, when a tight nozzle seal exists at boot 19, and vapor volume from tank 17 exceeds the displacement capability of vapor pump 24, a portion of said vapor bypasses said pump 24 to limit the system pressure. When, on the other hand, vapor volume is less than the displacement of pump 24, sufficient vapor is recycled from the discharge of the pump, to the suction thereof, whereby to limit the degree of vacuum created in tank 17.

More specifically, and as herein mentioned, the receiving tank 17 being filled with liquid fuel is normally of the type found on an automobile or a boat. In the latter, liquid fuel is held within either an enclosed, or a vented container. The latter is usually provided with one or more filler pipes 18 which extend from the tank. Filler pipe 18 is normally provided with a vented cap, not shown, which arrangement permits only a limited accumulation of vapors within the fuel tank 17.

This type of system avoids an excessive build-up of vapor pressure, particularly under warm weather conditions. Filler pipe 18 can be curved, or straight as presently shown. It may further be of the type adapted to accommodate only unleaded fuel as is presently found in many vehicles. The inlet end of filler pipe 16 can be provided with a lip 27 normally conformed to receive the engaging surface of the vented filler cap.

Fuel dispensing nozzle 16 is of the type normally utilized by the industry at service stations, and is manually operable to commence a fuel flow. It further includes means for automatically discontinuing the flow. The latter is achieved by providing pressure sensitive means within the nozzle itself to close main flow control valve 28 at such time as fuel tank 17 becomes filled, or when an excessive pressure builds up within the fuel system.

Physically, dispensing nozzle 16 includes an elongated body 29 which functions as a handle for manipulating the nozzle. Said body is provided with a plurality of internal passages 31 and 32. Passage 31 conducts liquid into receiving tank 17 by way of conduit 14. Similarly, passage 32 conducts vapor away from tank 17 for return to storage tank 10.

Body 29 is further provided at the rear end with a connection for engaging elongated fuel carrying conduit 14, as well as for engaging vapor carrying conduit 23. The forward end of body 29 is provided with extended nozzle spout 22 which communicates with internal fuel passage 31 by way of valve 28. Said spout 22 is of sufficient length to be received into tank filler pipe 18 prior to a fuel transfer operation. Spout 22 also includes means to fixedly engage the filler pipe, such as an external ring or the like. Thus, subsequent to the nozzle being inserted, it will be maintained in place.

Nozzle body 29 is further provided at the spout end with elongated, resilient walled boot 19. The latter in one form comprises a bellows shaped rubber member having sufficiently flexible walls that they can deform in response to internal pressure applied thereto. One end of cylindrical boot 19 sealably depends from nozzle body 29. The boot other end is opened, and provided with a sufficiently resilient lip to sealably engage the corresponding lip 27 of filler pipe 18.

When properly positioned, resilient walled boot 19 defines annular chamber 21 about spout 22. Annular chamber 21 further forms an enclosure into which vapor passage 32 opens such that vapor, which is received in the annular chamber from fuel tank 17, can be directed to storage tank 10.

The fuel storage means, as is the instance of most automotive service stations, comprises primarily one or more submerged storage tanks 10 which are periodically filled by a tanker, truck or other supply vehicle. Electrically powered pump 11 as noted herein, can be positioned above ground level within a pumping enclosure or submerged in tank 10. Said pump 11 is provided with a suction side which includes a filter 34 at the tank floor, or other means for filtering fuel prior to its passing upwardly. The discharge port of said pump 11 is communicated with an elongated fuel riser pipe 12, to hydraulic motor 13.

Fuel pump 11 is controlled by a manually actuated lever, switch, or similar device, conveniently positioned such that pumping action can be readily initiated by an operator, for a tank filling operation. Further, the direct interconnection between hydraulic motor 13 and vapor pump 24, that is, linkage member 20, permits the simultaneous removal of vapor from tank 17 during this filling operation.

Structurally, hydraulic motor 13 comprises basically an elongated cylindrical casing which defines an internal chamber 37. A piston 38 is reciprocally slidable within said chamber 37 being slidably sealed at the casing wall to maintain the fluid tight integrity of chamber 37.

Said piston 38 is connected through linkage 20, with a similar piston 39 within vapor pump 24. Chamber 37 is hydraulically sealed to permit free movement of the piston in response to the introduction of liquid into said chamber as will be hereinafter noted.

Apertures or ports 15 and 15' formed at opposed ends of chamber 37 permit the required introduction to, and discharge of liquid from said chamber. Said respective apertures are communicated through three-way valves 41 and 42 respectively to a common line 43. Line 43 is communicated in turn with conduit 12 which carries liquid from tank 10.

Said three-way valves 41 and 42 are physically interconnected with piston 38 by being sequentially actuated in accordance with the postion of the piston. Said three-way valves 41 and 42 are commonly interconnected by a linkage arm 61 as to be simultaneously adjusted. Arm 61 is in turn operably engaged through a second linkage arm 62 and collar 63, to piston connecting member 20.

Operationally, rod 20 is reciprocally moved in response to movement of piston 38. Displacement of rod 20 will cause valves 41 and 42 to be adjusted whereby to regulate flow of liquid into and from motor 13. Fuel will thus be alternately pumped into, and discharged from the respective ports 15 and 15' of chamber 37, in accordance with movement of piston 38 therethrough. The single fuel flow stream which commences at pump 11 and line 12, will in effect actuate or power motor 13 in accordance with the capacity of the pump.

Fuel flow is discharged from chamber 37 alternately by way of lines 44 and 46, each of which communicates with conduit 14. Thus, a continuous flow of liquid fuel will be passed into the nozzle 16 from conduit 14 so long as motor 13 is operated.

While not presently shown, it is appreciated that this fuel flow will ordinarily be measured for both quantity and cost, and will be accurately registered in the type of register as found at most fuel dispensing stations. Thus, fuel flow although shown being fed directly into the flexible line 14, can pass through other metering or registering means which will physically evaluate the said flow.

In the vapor return segment of the fuel system, vapor pump 24 comprises primarily a cylindrical casing which defines a vapor holding compartment 47. Piston 39 is slidably received in said compartment for reciprocatory movement therein. As in the instance of motor 13, the instant pump 24 includes a piston rod which is connected through a suitable sealing means in the pump end wall, to rod or linkage member 20. Movement of the respective pistons 38 and 39 is therefore coordinated with each other, as well as with valves 41 and 42.

Under usual operating conditions including a modest temperature differential between the fuel in tank 17 and that in tank 10, vapor leaving tank 17 passes through annular chamber 21, passage 32, and thereafter through conduit 23. Vapor flow is there impeded or completely blocked by vacuum relief valve 48 interposed such that the vapor flow is directed by way of check valve 51 and line 49 and port 25, into chamber 47.

Under these circumstances piston 39 will be moving in the direction of the arrow as will be piston 38. Check valve 51 will thus be urged into the open position by the vapor flow.

Simultaneously, vapor forced from port 26 at the opposed end of chamber 47, by piston 39, and discharged through line 54, will pass through open check valve 53. Vapor will then enter line 56 from which it will be forwarded to tank 10 by way of line 58.

Under these operating circumstances it will be presumed that vapor flow from tank 17 will substantially conform in volume to the incoming flow of liquid. However, these circumstances are contingent primarily on the temperature of the atmosphere and the temperature of liquid fuel in tank 10.

Under certain conditions it is found that during the flow of liquid into tank 17, there is virtually no vapor flow therefrom. This condition arises when incoming liquid fuel is colder than the fuel held in the tank 17. Thus, the vapors which would ordinarily be forced from the tank are in effect condensed by contact with the relatively cold fuel, thereby substantially obviating or perhaps eliminating completely vapor flow from tank 17.

In such an instance, to assure some flow of vapor through the return system, pump 24 is so arranged that rather than being forwarded, pumped vapor will be recirculated through chamber 47. Pressure in the upstream side of the vapor carrying line 23 will be relatively low. The position of the valves communicated with pump 24 will be as follows: valve 51 is open to flow, valve 52 is closed, valve 57 is closed, and valve 53 is open. Because of the reduced pressure in line 23, vacuum responsive valve 48 will open. Pumped vapor will therefore pass through line 56 and open valve 48, to again enter chamber 47 by way of valve 51.

In effect, the vapor circuit, including pump 24, will be a continuous circulatory passage by the vapor through chamber 47. Thus, so long as a low pressure exists in line 23, vapor will not be discharged into line 58 whereby to enter storage tank 10.

When during a fuel pumping operation the temperature of the atmosphere encourages evaporation of liquid fuel within tank 17, the amount of vapor passed from said tank as the liquid enters, will be excessive. Since as herein mentioned, pump 24 is of the positive displacement type, means is provided to permit a certain amount of the vapor in line 23 to bypass the pumping action of chamber 47 in pump 24 and flow directly to storage tank 10.

Thus, while the pump 24 will receive an amount of discharged vapor, which the pump is physically capable of handling, this will enter compartment 47 by way of line 23, check valve 51, and line 49. Nonetheless, check valve 57 will be urged into the open position responsive to pressure in line 49, such that the excessive vapor flow will be passed directly into tank 10 by way of lines 56 and 58. The remainder of the vapor which is passed through pump 24 will likewise be passed through check valve 53, into line 56 and to tank 10 by way of line 58.

Briefly, the instant arrangement is operable to provide a vacuum assist to the fuel system under any of the three circumstances. These are, when the flow of vapor from tank 17 is sufficient to establish a favorable V/L ratio between vapor and liquid flow. Secondly, when the V/L ratio is substantially less than that which is required by positive displacement pump 24. Thirdly, when the amount of vapor passing from tank 17 is excessive, thus requiring pressure relief by passing the vapor directly into the tank 10.

Other modifications and variations of the invention as hereinbefore set forth can be made without departing from the spirit and scope thereof, and therefore, only such limitations should be imposed as are indicated in the appended claims.

I claim:

1. In a system for conducting a vaporizable liquid fuel from a storage tank 10, to a receiving tank 17 having a filler pipe 18, and for concurrently removing vapor from said receiving tank 17 during a fuel transfer operation, a fuel dispensing nozzle 16 adapted to removably engage said receiving tank filler pipe 18 to form a vapor seal therewith, and having separate liquid 31 and vapor 32 passages therein, a hydraulic motor 13 having an elongated chamber 37 communicated with said storage tank 10 to receive a flow of fuel from the latter, said hydraulic motor 13 including a first piston 38 slidably mounted in said elongated chamber 37 for reciprocatory movement between opposed ends of said chamber 37 in response to said fuel flow being alternately introduced into the chamber respective opposed ends, a vapor pump 24 including a closed elongated chamber 47, a second piston 39 longitudinally received in said closed elongated chamber 47 for reciprocatory movement therein between respective ends of said elongated chamber 47, connecting means 20 operably engaging said respective first 38 and second 39 pistons to permit concurrent reciprocal movement thereof through the motor 13 and pump 24 elongated chambers, respectively, control valve means including at least two flow directing valves 41 and 42 communicated with said tank 10 and with the respective ends of said hydraulic motor chamber 37, said flow directing valve means 41 and 42 being operably connected 61, 62, 63 to said slidably mounted first piston 38 to be operated by the latter, and to direct sequential liquid flows through the control valve means to the respective ends of elongated chamber 37 in response to the disposition of the slidably mounted piston 38 during reciprocatory movement of the latter, and conduit means 14 communicating said two flow directing valves 41 and 42 to said nozzle 16 liquid passage 31, first vapor conduit means 23, 49, 54 communicating said nozzle vapor passage 32 with the respective opposed ends of said vapor pump 24 elongated chamber 47, check valve means 51 and 52 in said first vapor conduit means being operable to allow unidirectional flow of vapor to said elongated chamber 47 from said vapor passage 32, vapor return conduit means 56 and 58 communicating the respective elongated chamber 47 ends with said tank 10, and check valve means 53 and 57 disposed in said vapor return conduit means to permit unidirectional vapor flow to said tank 10, whereby to direct vapor flow to said tank 10 in response to reciprocatory movement of said piston 38 in said elongated chamber 47, a pressure responsive valve 48 communicating said nozzle vapor passage 32 with said tank 10, said valve 48 being operable to the open position in response to a predetermined pressure within said vapor passage 32 to bypass vapor flow around said first vapor conduit means 23, 49, 54 and said vapor return conduit means 56, 58, into said tank 10, and when said pressure responsive valve 48 is in the closed position at a pressure less than said predetermined pressure the vapor flow will be delivered from said vapor passage 32 to said vapor pump 24 elongated chamber 47.

2. In the system as defined in claim 1, wherein said hydraulic motor and said vapor pump are disposed in substantial axial alignment.

3. In the system as defined in claim 1, wherein said first and second pistons include a common piston rod.

* * * * *